United States Patent [19]

Reed

[11] Patent Number: 4,733,865

[45] Date of Patent: Mar. 29, 1988

[54] BASEBALL BATTING PRACTICE APPARATUS

[76] Inventor: Lawrence Reed, 13641 Hart Dr., Cerritos, Calif. 90701

[21] Appl. No.: 28,869

[22] Filed: Mar. 23, 1987

[51] Int. Cl.[4] ..... A63B 69/00

[52] U.S. Cl. ..... 273/26 A; 273/181 F

[58] Field of Search ..... 273/26 A, 29 A, 181 F, 273/181 G, 182 R, 410, 182 A, 411, 1 R, 176 F; 135/120, 102

[56] References Cited

U.S. PATENT DOCUMENTS

| | | | |
|---|---|---|---|
| 1,923,297 | 8/1933 | Cooper | 273/26 A |
| 1,931,387 | 10/1933 | Kelliher | 273/26 A |
| 2,292,109 | 8/1942 | Engel | 273/26 A |
| 2,819,901 | 1/1958 | Mateja | 273/26 A |
| 2,923,547 | 2/1960 | Heeremans | 273/26 A |
| 3,222,067 | 12/1965 | Litwhiler et al. | 273/26 A |

OTHER PUBLICATIONS

Cleo-Lerners Aids, p. 29, 2/28/76.

*Primary Examiner*—Richard C. Pinkham
*Assistant Examiner*—T. Brown
*Attorney, Agent, or Firm*—Charles H. Thomas

[57] ABSTRACT

A batting practice apparatus includes a batting cage which has a relatively small, closed rear end and a relatively large, open front end. The batting cage is located above a level playing surface and extends over a batting position which is proximate to the closed rear end, and remote from the open front end. A vertical retaining screen is located in front of the open front end of the batting cage and extends in an arc thereabout. Indicia on the retaining screen define a plurality of horizontally extending bands, one above another. Baseballs hit from the batting position through the open front end of the batting cage will either strike the ground before reaching the retaining screen, or strike the retaining screen without first hitting the ground. The vertically adjacent horizontal bands indicate that a ball striking the retaining screen without first hitting the ground is classified as a single, double, triple or home run. The height of the retaining screen is just great enough to stop batted balls which barely clear the forward overhead edge of the batting cage. Likewise, the retaining screen extends laterally only a sufficient distance to stop batted balls which barely clear the forward edges of the sides of the batting cage.

14 Claims, 3 Drawing Figures

BASEBALL BATTING PRACTICE APPARATUS

BACKGROUND OF THE INVENTION

1. Field of the Invention

The present invention is an apparatus adapted for use in practicing hitting a baseball from a batting position on a level playing surface.

2. Description of the Prior Art

Numerous systems have been devised to aid players, both amateur and professional, in improving prowess in hitting a baseball. The sport of baseball is played in many countries throughout the world. The actual sport of baseball requires a very large area upon which a game of baseball may be played. In the conventional rules of professional baseball the pitching rubber is located sixty feet distant from the batting position, which is termed a home plate. Three additional bases are arranged with the home plate at the corners of a square that surrounds the pitching rubber and extends ninety feet on a side. A hitter in baseball, standing adjacent to the batting position defined by the home plate, attempts to hit a pitched ball in the air as far as possible and within the ninety degree angle formed between third base, home plate and first base. A baseball and a baseball bat are constructed so that it is possible for talented hitters to hit a baseball well beyond the ninety foot distance between home plate and the nearest bases. Accordingly, even small children who cannot hit a baseball great distances require a playing field of a very substantial area within which to play a game of regulation baseball. Even the smallest baseball fields used in organized, amateur baseball leagues for adolescent children require a circular sector shaped playing area that extends over an arc of ninety degrees and which is at least about one hundred fifty feet along each side. Naturally, the playing areas designed for older and more mature, developed players are considerably greater and require several times as much area as small, amateur playing fields for very youthful players.

Due to the considerable playing area which is required to play a game of baseball, systems for practicing hitting a baseball are, to a large extent, unsatisfactory. Young, amateur players are frequently unable to obtain access to full size baseball playing fields for the purpose of practicing hitting. Due to the large size of even the smallest baseball fields, most baseball playing fields are controlled by park districts and other municipal government agencies. In populated areas there is often intense competition among individuals and organizations to obtain time allotments for the use of a full sized baseball playing field for purposes of practicing. Individuals seeking to practice hitting frequently attempt to do so in small groups, so that each individual involved will have the maximum opportunity to practice batting. The division of amateur baseball players into such small groups intensifies the demand for access to full size baseball playing fields for purposes of practicing. Also, the strategy of practicing in small groups is to a certain extent counterproductive, since a great deal of time is spent retrieving baseballs which have been hit far afield in full size baseball fields and less time is thus available for the actual practice of hitting baseballs.

To attempt to remedy the significant shortages in opportunities for the practice of hitting baseballs, a very substantial industry has developed in the form of commercial establishments which provide a series of batting cages and automatic pitching machines which are made available for a fee to baseball enthusiasts for use in practicing hitting. Such cages are typically packed together in a row, separated from each other by narrow mesh partitions. The area within which each individual who is practicing may hit a ball is defined as a narrow tunnel between the partitions and beneath an overhead screen. Because of the totally enclosed nature of the hitting area, the hitter receives only very limited indications of the proficiency with which he or she is hitting. Due to the narrow confines of commercial batting practice hitting enclosures, virtually the only indication of proficiency in hitting is the tactile sensation which a hitter receives when the bat is swung into solid contact with a baseball, into glancing contact with a baseball, or when the bat misses the ball completely. However, because the ball cannot travel more than a few feet before striking a confining screen, the hitter is largely at a loss to judge the effectiveness of any adjustments which are made in order to improve hitting prowess. Moreover, the cost of practicing at commercial batting cages is frequently prohibitive for many amateur baseball enthusiasts.

SUMMARY OF THE INVENTION

The present invention involves the provision of an apparatus adapted for use in practicing hitting a baseball from a batting position on a level playing surface. The system or apparatus of the invention solves many of the difficulties which players, particularly young amateur players, have encountered in attempting to improve their hitting. The present invention employs both a batting cage means and a retaining screen means. The batting cage means has an open front end remote from the batting position, which is the home plate. The batting cage also has a closed rear end proximate to the home plate batting position. The cross sectional area of the open front end is larger than that of the closed rear end. The retaining screen means is an upright structure extending in a concave arc in front of the open front end of the batting cage means and has indicia thereon which define a plurality of horizontally extending, vertically adjacent bands. The batting cage means and the retaining screen means are dimensioned and spaced such that all lines of sight from at least a foot above the home plate from within the batting cage means through the open front end of the batting cage intersect the retaining screen means at all locations above the playing surface thereon. That is, all straight lines emanating from a distance no less than one foot above the home plate and which also pass through the open front end of the batting cage, intercept the retaining screen at all locations above the playing surface.

A baseball batting practice system according to the invention has several very significant advantages over prior art systems for practicing hitting a baseball. One very significant advantage is that the hitter is unequivocally informed of the proficiency with which each batted ball has been hit. The dimensions and spacing of the batting cage and the retaining screen can be coordinated so that batted balls which in an actual game of baseball would be foul balls, shallow fly balls to the outfield, or infield fly balls, all strike the confining walls and roof of the batting cage. Batted balls which are hit in fair territory will travel outwardly through the open end of the batting cage. However, those batted balls which have been hit through the open front end of the batting cage, but which have been hit improperly so that they would result in easy infield outs in an actual game of baseball, will fail to reach the retaining screen before striking the playing surface. Thus, if an individual is hitting balls in fair territory through the open front end of the batting cage, but consistently on the ground such that the balls fail to reach the retaining screen on the fly, the individual is so informed by visual observation of this result and can make adjustments to improve the proficiency of hitting.

Furthermore, because the retaining screen is divided into vertically adjacent horizontal bands, batted balls which strike the retaining screen on the fly without first hitting the playing surface can also be graded. The indicia on the retaining screen delineates the lowest band as corresponding to a single in an actual game of baseball. The second lowest band is preferably designated as a double, while the third lowest band is graded as a triple. If a batted ball is hit through the open front end of the batting cage and strikes the uppermost band of the retaining screen, a home run is indicated. To achieve an accurate correlation of the bands which are hit with the probable results of hitting a ball in a similar fashion in an actual game of baseball, the vertical widths of the horizontal bands can be calibrated with respect to the different distances between bases and the different age groups of players in the leagues for which the hitters are practicing.

Preferably, the maximum height of the open front end of the batting cage is between about seven and ten feet above the playing surface, and the retaining screen is preferably between about eighteen and twenty four feet in height above the playing surface. Preferably also, the retaining screen is everywhere between about sixty and about seventy feet distant from the batting position. Preferably also, the open front end of the batting cage is located a distance of between about twenty feet and about twenty six feet forward of the home plate batting position.

The dimensions and spatial distances of separation employed in the component elements of the invention are extremely important, as they are significant when considered in view of the actual dimensions employed in regulation, organized baseball. Most organized baseball leagues for young players of between ten and sixteen years in age employ baseball diamonds which have baselines of either sixty or seventy five feet between adjacent bases. With a batting cage and a retaining screen configured and arranged relative to each other in the preferred manner of the invention, as hereinbefore described, batted balls which would be foul balls, infield fly balls, or shallow fly balls to the outfield in actual games between such young players, will strike the confines of the batting cage. Moreover balls which are hit through the open front end of the batting cage but which probably would be fielded as ground balls in actual games among such players will not reach the retaining screen without first striking the playing surface. Four horizontally extending bands of approximately equal vertical widths on a retaining screen having dimensions within the preferred range of dimensions as described will correspond with reasonable accuracy to the number of bases which a hitter would achieve from such a hit in an actual baseball game.

The baseball batting practice apparatus of the present invention has a very significant advantage over conventional systems in that it can be set up in an area far smaller than the area required for playing an actual game of baseball. Since the retaining screen is preferably located no more than about seventy feet distant from the batting position of the home plate, the baseball batting practice apparatus of the invention can be erected and utlilized on a semi-permanent basis in residential back yards of moderate to large size. With the apparatus of the invention, an individual no longer requires access to the full size playing fields which are utilized by baseball players for playing actual games in organized leagues. Thus, individual baseball enthusiasts have available a baseball batting practice system which they may employ for use at home.

A further advantage of the invention is that all batted balls are entrapped within the confines of the batting cage and the retaining screen. Thus, a hitter may practice hitting with the baseball batting practice apparatus of the invention in close proximity to neighboring houses and buildings with little danger that a batted ball will escape and cause property damage or personal injury. With the apparatus of the invention all dimensions of the batting cage and the retaining screen, and the distance of separation therebetween, are such that all straight lines extending from a location no less than one foot directly above the home plate batting position on the playing surface and through the open front end of the batting cage will intersect the retaining screen, unless those straight lines intersect the playing surface between the batting position and the retaining screen. The extent of travel of batted balls is thereby limited to the space between the batting cage and the retaining screen.

A further advantage of the invention is that due to the relatively small area required for use of the batting practice system of the invention, as contrasted with regulation playing fields, the extent of travel of batted balls is significantly limited. Thus, a relatively few number of individuals who are practicing will spend far less time in retrieving batted balls than is the case when practice is conducted by only a few individuals on a full size playing field. The vast reduction in time required to collect batted balls significantly increases the amount of time available for actually hitting baseballs.

The invention may be described with clarity and particularity by reference to the accompanying drawings.

DESCRIPTION OF THE EMBODIMENT

Figure 1:
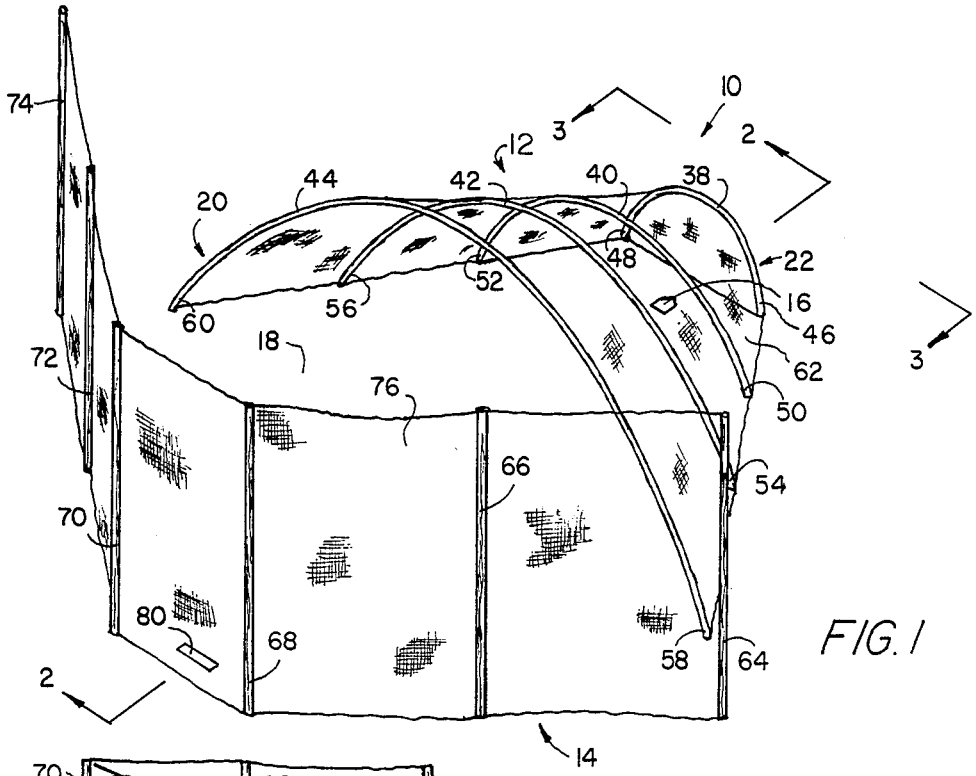
FIG. 1 is a perspective view of a preferred embodiment of the invention.
Figure 2:
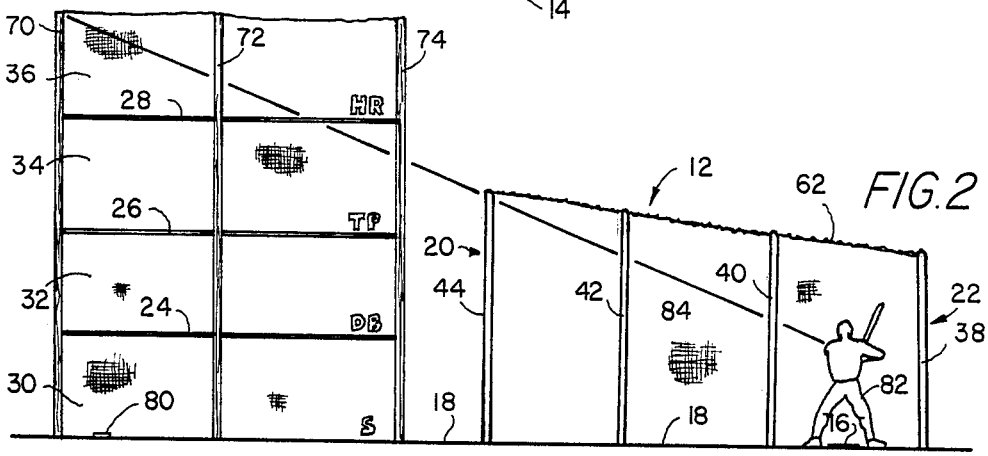
FIG. 2 is a side sectional elevational view taken along the lines 2—2 of FIG. 1.
Figure 3:
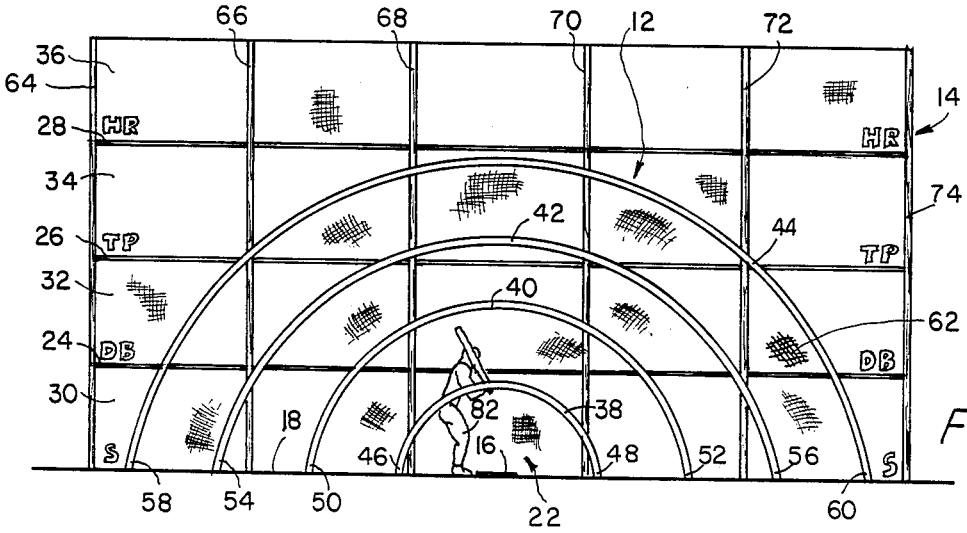
FIG. 3 is an end elevational view taken along the lies 3—3 of FIG. 1.

FIG. 1 illustrates a baseball batting practice apparatus 10 comprised of a batting cage 12 and a retaining screen 14. The batting cage 12 is formed above a batting position, which is termed a home plate. The home plate 16 is located flush or nearly flush with a flat playing surface indicated at 18. The batting cage 12 has an open front end 20 and a closed rear end 22. As depicted in FIG. 2 the open front end 20 is located forward and remote from the home plate 16 and the closed rear end 22 is located behind and proximate to the home plate 16. As depicted in FIGS. 1 and 3, the open front end 20 defines an opening of greater cross sectional area than the closed rear end 22.

The retaining screen 14 is an upright vertically disposed structure which extends in a concave arc about the open front end 20 of the batting cage 12. The retaining screen 14 includes indicia thereon, indicated as horizontal stripes 24, 26 and 28, which delineate a plurality of horizontally extending, vertically adjacent bands 30, 32, 34 and 36.

The batting cage 12 and the retaining screen 14 are dimensioned and spaced relative to each other such that all straight lines which emanate from a distance no less than one foot directly above the home plate 16 on the playing surface 18 and which do not intersect the playing surface 18 between the home plate 16 and the retaining screen 14, and which also pass through the open end 20 of the batting cage 12, intersect the retaining screen. Stated another way, the batting cage 12 and the retaining screen 14 are dimensioned and spaced such that all of the lines of sight from at least one foot directly above the home plate 16 within the batting cage 12, through the open end 20, intersect the retaining screen 14 at all locations above the playing surface 18.

The foregoing description reduces to specific ascertainable terms the overriding concept that all batted balls which are hit from above the home plate 16 will be stopped by the retaining screen 14 if they are hit through the open front end 20 of the batting cage 12. Otherwise, they remain within the batting cage 12.

The batting cage 12 is formed of a plurality of upright supports 38, 40, 42 and 44 which are of arcuate configuration, as illustrated, and which stand symmetrically on either side of a vertical plane passing through home plate 16 and through the center of the retaining screen 14, and along which the view of FIG. 2 of the drawings is taken. Each of the arcuate upright supports 38–44 may be formed of lightweight, tubular aluminium. Each of the supports 38–44 terminates at the flat playing surface 18 in feet or standards which are indicated at 46–60. The standards 46–60 are comprised of exposed portions, visible above the grade of the playing surface 18 in the drawings, and downwardly extending ends which are not visible in the drawings because they extend to a depth of about a foot and a half beneath the playing surface 18. The standards 46–60 are thereby adapted for mounting relative to the flat playing surface 18 and span a predetermined distance at the level of the playing surface 18.

As illustrated in FIGS. 1 and 3, the distance spanned by the standards 46–60 increases among the supports 38–44 proceeding forward relative to the home plate 16 toward the forward extremity of the batting cage 12 which forms the open front end 20. The largest arcuate support 44 defines the opening of the open front end 20, while the smallest arcuate support 38 encompasses the closed end 22 at the rear extremity of the batting cage 12.

The batting cage 12 is further comprised of a tough, weather impervious fabric mesh netting or screen material 62 which may, for example, be formed of nylon mesh. The nylon mesh screen material 62 extends across the top and sides of the arcuate supports 38–44 to define a batting enclosure therewithin. The screen material 62 also extends across the face of the closed end 22 to form the end closure thereof. The fabric mesh material 62 may be secured to the supports 38–44 by means of fastening clips. Alternatively, sleeves may be sewn into the fabric material 62 at spaced longitudinal intervals to accommodate the supports 38–44 therewithin.

The retaining screen 14 is constructed of a plurality of vertical posts 64–74 spaced laterally from each other as illustrated in FIG. 1. The posts 64–74 may be constructed of lightweight aluminum tubing, and preferably extend above the playing surface 18 to a height of between about eighteen and twenty four feet. The lower extremeties of the posts 64–74 are preferably buried to a depth of about four feet below the grade of the playing surface 18 in order to sufficiently stabilize the retaining screen 14. The posts 64 and 74 are spaced apart a distance greater than are the feet 58 and 60 of the support 44.

The retaining screen 14 is also comprised of a weather resistant fabric mesh screen or netting material 76, which is attached to the posts by clamping rings or by hooks which engage the upper extremities of the hollow posts 64–74. The screen material 76 likewise may be formed of nylon mesh. Both the screen material 62 and the screen material 76 are strong enough to resist tearing, but are also light in weight. Both the screen material 62 and the screen material 76 have a mesh opening size which is large enough so as not to unduly obscure visibility therewithin or therethrough. Thus, one can see through the batting cage 12 and the retaining screen 14 to a large degree.

As best illustrated in FIGS. 2 and 3, the retaining screen 14 is provided with indicia which provide a grade or score for batted balls which strike the retaining screen 14. The indicia include letters which may be silkscreened onto the mesh fabric material 76. The letter "S" designates the lowest band 30 as a single. The next lowest band 32 is designated as a double by the letters "DB". Above the band 32 the next lowest band 34 is designated as a triple by the letters "TP", while the highest band 36 is designated as a home run by the letters "HR".

With the batting batting practice apparatus 10 of the invention, it is possible for a very small number of individuals to practice the sport of baseball, and to maintain an interest in practicing by keeping score. To practice in this manner, one player may pitch to a batter standing to one side or the other of the home plate 16 from the real or simulated pitching rubber 80. The pitching rubber 80 is located on the playing surface 18, preferably just within the enclosure formed by the retaining screen 14. From the pitching rubber 80 the pitcher will pitch to a batter standing beside the home plate 16. A batter is indicated at 82 in FIGS. 2 and 3. When the batter 82 strikes a pitched ball and hits the ball through the open front end 20 of the batting cage 12 such that the ball strikes the retaining screen 14 without first hitting the playing surface 18, the batter 82 scores a hit as denoted by the indicia on the screen material 76. With successive hits that strike the retaining screen 14, the batter 82 can increase a score as simulated runners progress in accordance with the bands 30–36 against which the batter 82 hits the baseball pitches. The players may take successive turns as the batter 82 and keep score in this manner so as to simulate the score of an actual baseball game.

In the preferred embodiment of the invention the maximum height of the open front end 20 of the batting cage 12 is preferably about eight feet above the playing surface 18. Likewise in the preferred embodiment, the retaining screen 14 is preferably a uniform height of about twenty one feet. The retaining screen 14 is preferably everywhere between about sixty and about seventy feet distant from home plate 16. The width of the front end 20 of the batting cage 20, as measured between the feet 58 and 60 at the playing surface 18, is preferably about forty two feet. The open front end 20 of the batting cage 12, as measured by the plane of the arcuate support 44, is preferably about twenty three feet forward from the home plate 16.

As previously noted, an extremely important aspect of the invention is that the batting cage 12 and the retaining screen 14 are dimensioned and spaced such that all of the lines of sight from at least a foot directly above the home plate 16 within the batting cage 12 and though the open front end 20 intersect either the retaining screen 14 or the playing surface 18. One such straight line is indicated at 84 in FIG. 2. It can therefore be seen that even if the batter 82 hits a low pitch squarely so that it passes just beneath the center of the support 44, the parabolic trajectory which results from the force of gravity acting upon a baseball will ensure that the ball will not pass over the upper extremity of the band 36, but instead will fall within the enclosure defined between the retaining screen 14 and the batting cage 12. Likewise, balls which are batted through the opening of the forward, open front end 20 and which just barely clear the sides of the support 44, will likewise not pass beyond the outermost posts 64 and 74 of the retaining screen 14, but rather will strike the retaining screen 14 somewhere between the posts 64 and 74. The significance of defining the relative dimensions of the batting cage 12 and retaining screen 14 from a location one foot directly above home plate 16 is that the vertical distance of one foot directly above home plate 16 corresponds to the lowest extremity of the strike zone of even a batter of short stature.

Undoubtedly, numerous variations and modifications of the invention will become readily apparent to those familiar with the sport of baseball. Accordingly, the scope of the invention should not be construed as limited to the specific embodiment depicted and described herein, but rather is defined in the claims appended hereto.

I claim:

1. A baseball batting practice system comprising a batting cage extending over a batting position on a flat, playing surface and having a plurality of upright support means each of which have standards on opposite sides of said batting position adapted for mounting relative to said flat playing surface and which span a predetermined distance at the level of said playing surface, and said distance spanned by said standards increases among said support means proceeding forward from said batting position and wherein said support means increase in length and height proceeding forward from said batting position and said batting cage forms an open end at its forward extremity remote from said batting position and a closed end at its rearward extremity proximate to said batting position, and an upright, vertically oriented retaining screen disposed in a concave arc in front of said open end of said batting cage, and spaced a predetermined distance therefrom and wherein said ends of said retaining screen are spaced apart a distance greater than the greatest distance spanned by said standards of said support means, said height of said retaining screen is greater than the greatest height of said support means, and said retaining screen has indicia dividing said retaining screen throughout into at least four horizontal bands located vertically one above another.

2. A baseball batting practice system according to claim 1 wherein the maximum height of said open end of said batting cage is about eight feet above said playing surface and said height of said retaining screen is uniform and is about twenty one feet above said playing surface.

3. A baseball batting practice system according to claim 2 wherein said retaining screen is between about sixty and about seventy feet distant from said batting position throughout its length.

4. A baseball batting practice system according to claim 1 wherein said indicia designate the lowest of said bands as a single, the next lowest of said bands as a double, the next lowest of said bands as a triple and the highest of said bands as a home run.

5. A baseball batting practice system according to claim 1 wherein the dimensions of said batting cage and retaining screen and the distance of separation therebetween are such that all straight lines extending from a location no less than one foot above said playing surface at said batting position through said open end of said batting cage intersect said retaining screen unless they intersect said playing surface between said batting position and said retaining screen.

6. A baseball batting practice system according to claim 1 wherein the dimensions of said batting cage and said retaining screen and the distance therebetween are such that all straight lines extending from a location no less than one foot above said playing surface at said batting position and which pass through said open end of said batting cage and which fail to intersect said playing surface between said batting position and said retaining screen, all intersect said retaining screen.

7. A baseball batting practice system according to claim 1 wherein said retaining screen is constructed of a plurality of vertical posts spaced laterally from each other and of fabric mesh screen material attached to said posts and extending therebetween.

8. A baseball batting practice system according to claim 7 wherein said batting cage is further comprised of fabric mesh screen material extending across said support means.

9. A baseball batting practice apparatus comprised of a batting cage and a retaining screen wherein said batting cage is formed above a batting position on a flat playing surface and has a forward open end and a rearward closed end and said forward open end is located remote from said batting position and defines an opening of greater cross sectional area than said closed end, and said closed end is located proximate to said batting position, and said retaining screen is vertically disposed and extends in a concave arc about said open end of said batting cage and is spaced a predetermined distance therefrom and includes indicia thereon which delineate a plurality of horizontally extending, vertically adjacent bands, and said batting cage and said retaining screen are dimensioned and spaced relative to each other such that all straight lines emanating from a distance no less than one foot above said playing surface at said batting position and which extend above said playing surface between said batting position and said retaining screen and which also pass through said open end of said batting cage intersect said retaining screen.

10. A baseball batting practice apparatus according to claim 9 wherein the maximum height of said open end of said batting cage is between about seven and ten feet above said playing surface, and said retaining screen is between about eighteen and twenty four feet in height above said playing surface and said retaining screen is everywhere between about sixty and about seventy feet from said batting position.

11. A baseball batting practice apparatus according to claim 10 wherein said open end of said batting cage is located a distance of between about twenty feet and about twenty six feet forward of said batting position.

12. A baseball batting practice apparatus according to claim 9 wherein said retaining screen and said batting cage are both comprised of open mesh fabric screening material.

13. An apparatus adapted for use in practicing hitting a baseball from a batting position on a level playing surface comprising a batting cage means and a retaining screen means wherein said batting cage means has an open front end remote from said batting position and a closed rear end proximate to said batting position, and the cross sectional area of said open front end is larger than that of said closed rear end, and said retaining screen means is an upright structure extending in a concave arc in front of said open end of said batting cage means a predetermined distance therefrom and has indicia thereon which define a plurality of horizontally extending, vertically adjacent bands, and said batting cage means and said retaining screen means are dimensioned and spaced such that all lines of sight from at least a foot above said batting position within said batting cage means through said open front end intersect said retaining screen means unless they intersect said playing surface.

14. An apparatus according to claim 13 wherein the maximum height of said front end of said batting cage means is about eight feet and the width of said front end of said batting cage means is about forty two feet at said playing surface, and said front end of said batting cage means is located about twenty three feet forward from said batting position and said retaining screen means is about twenty one feet in height above said playing surface and between about sixty and about seventy feet distant from said batting position.

* * * * *